US009456685B2

(12) United States Patent
Wade-Smith

(10) Patent No.: US 9,456,685 B2
(45) Date of Patent: Oct. 4, 2016

(54) TABLE

(71) Applicant: Robert Wade-Smith, Nr. Maplas (GB)

(72) Inventor: Robert Wade-Smith, Nr. Maplas (GB)

(73) Assignee: Charles Edward Wade-Smith, Hebden (GB)

( * ) Notice: Subject to any disclaimer, the term of this patent is extended or adjusted under 35 U.S.C. 154(b) by 0 days.

(21) Appl. No.: 14/414,619

(22) PCT Filed: Jul. 12, 2013

(86) PCT No.: PCT/GB2013/051872
§ 371 (c)(1),
(2) Date: Jan. 13, 2015

(87) PCT Pub. No.: WO2014/009750
PCT Pub. Date: Jan. 16, 2014

(65) Prior Publication Data

US 2015/0164220 A1 Jun. 18, 2015

(30) Foreign Application Priority Data

Jul. 13, 2012 (GB) ..... 1212482.2

(51) Int. Cl.
*A47B 57/00* (2006.01)
*A47B 13/08* (2006.01)

(52) U.S. Cl.
CPC ..... *A47B 13/088* (2013.01); *A47B 2200/004* (2013.01); *A47B 2200/0046* (2013.01)

(58) Field of Classification Search
CPC .. A47B 11/00; A47B 13/081; A47B 13/088; A47B 37/00; A47B 2037/00; A47B 2038/02; A47B 2200/004; A47B 2200/0045; A47B 2200/0046
See application file for complete search history.

(56) References Cited

U.S. PATENT DOCUMENTS 565,180 A * 8/1896 Rucquoy ..... A47B 11/00 108/94
3,342,147 A * 9/1967 Shettles ..... A47B 87/002 108/185
4,732,088 A * 3/1988 Koechlin ..... A47B 87/002 108/185
4,927,214 A * 5/1990 Kaufman ..... A61B 19/0248 108/159

(Continued)

FOREIGN PATENT DOCUMENTS

DE 20 2010 014611 1/2012
EP 0 223 091 5/1987

(Continued)

OTHER PUBLICATIONS

WO patent application No. PCT/GB2013/051872, International Search Report mailed Nov. 29, 2013.

(Continued)

*Primary Examiner* — Daniel Rohrhoff
(74) *Attorney, Agent, or Firm* — Weaver Austin Villeneuve & Sampson LLP

(57) ABSTRACT

A table (1) capable of accommodating place settings for a plurality of people is provided. The table (1) comprising a first table top (2) and a second table top (3), both of which are capable of accommodating place settings for one or more people. The place settings on the first table top (2) being alignable with the second table top (3) place settings so that at least two people at the table (1) are face to face. The first and second table tops are moveable relative to one another so that the alignment of the first table top place settings and the second table top place settings can be varied.

11 Claims, 3 Drawing Sheets

(56) References Cited

U.S. PATENT DOCUMENTS

| | | | | |
|---|---|---|---|---|
| 5,483,898 | A * | 1/1996 | Seidl | A47B 17/02 108/3 |
| 5,531,168 | A * | 7/1996 | Towfigh | A47B 17/02 108/108 |
| 5,655,822 | A * | 8/1997 | Roberts | A47B 21/007 108/50.01 |
| 5,752,448 | A * | 5/1998 | Eyre | A47B 17/02 108/20 |
| 6,182,581 | B1 * | 2/2001 | Boyce | A47B 3/12 108/67 |
| 8,407,944 | B2 * | 4/2013 | Baloga | A47B 87/002 52/234 |
| 2007/0068429 | A1 | 3/2007 | Frazier | |
| 2008/0078996 | A1 * | 4/2008 | Usuda | H01L 22/34 257/48 |
| 2011/0309654 | A1 * | 12/2011 | Di Camillo | B60J 5/00 296/187.03 |
| 2015/0083029 | A1 * | 3/2015 | Pan | A47B 13/088 108/104 |

FOREIGN PATENT DOCUMENTS

| | | |
|---|---|---|
| FR | 2 668 906 | 5/1992 |
| WO | 2014/009750 | 1/2014 |

OTHER PUBLICATIONS

WO patent application No. PCT/GB2013/051872, Written Opinion mailed Jan. 15, 2013.

* cited by examiner

TABLE

CROSS REFERENCE TO RELATED APPLICATIONS

This application is the U.S. National Phase under 35 U.S.C. §371 of PCT/GB2013/051872, filed on Jul. 12, 2013, which claims the benefit of priority to GB1212482.2, filed on Jul. 13, 2012.

FIELD OF THE INVENTION

The present invention relates to tables and in particular tables for seating large groups of people at a social or business event.

BACKGROUND OF THE INVENTION

Historically the table has always been a meeting point where people come together to eat, drink and communicate with one another. Whether in a family home, a restaurant or a larger social gathering, the table's role is central.

Indeed the table's importance extends beyond merely providing a place for eating and is arguably just as important in other forms of human interaction such as business meetings.

The act of sharing the common space of the table top plays an important role in the socialisation of the people sat around the table as it brings the people face to face with one another. This enables the people to communicate with not only those people sat beside them at the table but also those people sat across the table.

However as tables grow in size to accommodate more people the socialising benefits are reduced because, although the number of people seated at the table increases, the total number of people within any one person's communication range does not and in fact can be reduced to the extent that only their immediate neighbours are within communication range.

SUMMARY OF THE INVENTION

The present invention seeks to address the communication limitations facing an individual seated at a table with a large number of people. For the purposes of describing the present invention a group of sixteen or more people is considered appropriate. To this end the present invention provides a table according to claim 1.

By forming the table from two separate table tops, each of which accommodates a plurality of place settings, and moving the table tops relative to one another it is possible to align different place settings on the table over time. In this way a person sat at a particular place setting is brought into face to face contact with a variety of different people as their place setting aligns with the respective place setting of other people at the table.

Preferably the first table top may provide an inner edge of the table that at least partially defines an inner region within which people whose place setting is on the first table top can be situated.

Preferably the second table top may provide an outer edge of the table around which people whose place setting is on the second table top can be situated.

Preferably the table may be generally circular in shape. When the table is generally circular in shape it is envisaged that the first table top is also generally circular in shape and provides an inner ring of the table. The second table top, which would also be generally circular in shape, provides an outer ring of the table.

It is appreciated that a generally circular shape, rather than say a rectangular shaped table, is preferable because it enables a relatively large number of people to be accommodated in a space efficient manner. However it is anticipated that alternative table shapes may be adopted without departing from the general concept of the invention.

It is appreciated that even if the overall shape of the table is not circular it may be preferable for the first table top to be generally circular in shape to enable the relative movement of the first and second table tops to be achieved by rotating the first table top within and relative to the second table top.

Preferably the table may further comprise indexing means to facilitate the alignment of the place settings of the first table top with the place settings of the second table top. The indexing means would allow table ware (e.g. plates, cutlery, etc.) to be located in a position on the first or second table top which is will be alignable with another place setting.

Preferably the first and second table top may each have at least one gap therein which, when aligned, provide a means of entry to (and egress from) the inner region of the table. The access point created by the alignment of the gaps in the first and second table tops can be used by both the people sitting in the inner region of the table and also the people serving at the table (e.g. waiters/waitresses).

It is appreciated that the first and/or second table tops may be made up of more than one table top portion. This is likely to be the case when the first and/or second table tops have more than one entry/egress gap therein.

Advantageously the indexing means may also facilitate the alignment of the gaps in the first and second table tops. In this way, for example in the case of an emergency, the gaps can be aligned to allow people to readily exit the inner region of the table.

Preferably the table may further comprise a protective lip that extends over the area of the table where the first and second table top come into close proximity. It is appreciated that it is advantageous to cover the space between the first and second table tops, not only for safety reasons but also to prevent objects falling into the space and possibly impeding the relative movement of the table tops.

The protective lip may be provided as an extension of either the first or second table top. However it is appreciated that alternative arrangements for covering the space between the first and second table tops are possible.

Preferably the table may further comprise a base with a first supporting platform for the first table top and a second supporting platform for the second table top; and wherein the movement of either the first platform, second platform or both platforms provides the relative movement of the first and second table tops.

Preferably the table base may comprise drive means which control the movement of first and second platforms. In this way the mechanisms for controlling the movement of the table tops is safely contained and cannot cause a hazard to the people using the table.

Preferably the first supporting platform may have one or more seats secured to it. In this way positioning of the seating within the limited space of the table inner region can be optimised.

The present invention also provides a method of increasing the inter-personal communication opportunities of a plurality of people at a table in accordance with claim 12.

Preferably wherein the relative movement of the first and second table tops may be continuous but at a nominal speed. A range of between half a circuit per hour and four circuits per hour is considered appropriate. A single circuit is completed when a given place setting on the first table top re-aligns with the place setting on the second table top that it was initially aligned with.

Alternatively the relative movement of the first and second table tops may occur periodically at predetermined time intervals. It is considered appropriate that the place settings may be re-aligned once every 30 minutes. It is envisaged that the periodic movement, when it occurs, will be at a faster speed that in the case of the continuous movement embodiment.

BRIEF DESCRIPTION OF THE DRAWINGS

The present invention will now be more particularly described with reference to the accompanying drawings in which.

DETAILED DESCRIPTION OF THE DRAWINGS

Typically people sat at a large table, such as a dining table for example, with more than twelve people can find it difficult to communicate with all but those diners sat closest to them at the table. In particularly noisy environments communication can be restricted such that people can only really hold a conversation with their immediate neighbours at the table.

The general aim of the present invention is to provide a table suitable for a large group of people (typically 16, 24, 36 or more) which enables the people at the table to talk with a bigger number of their fellow diners at a social event. The table of the present invention achieves this by moving people and their place settings over the duration of a social event so that they are brought in to face to face contact with different people over time.

Figure 1:
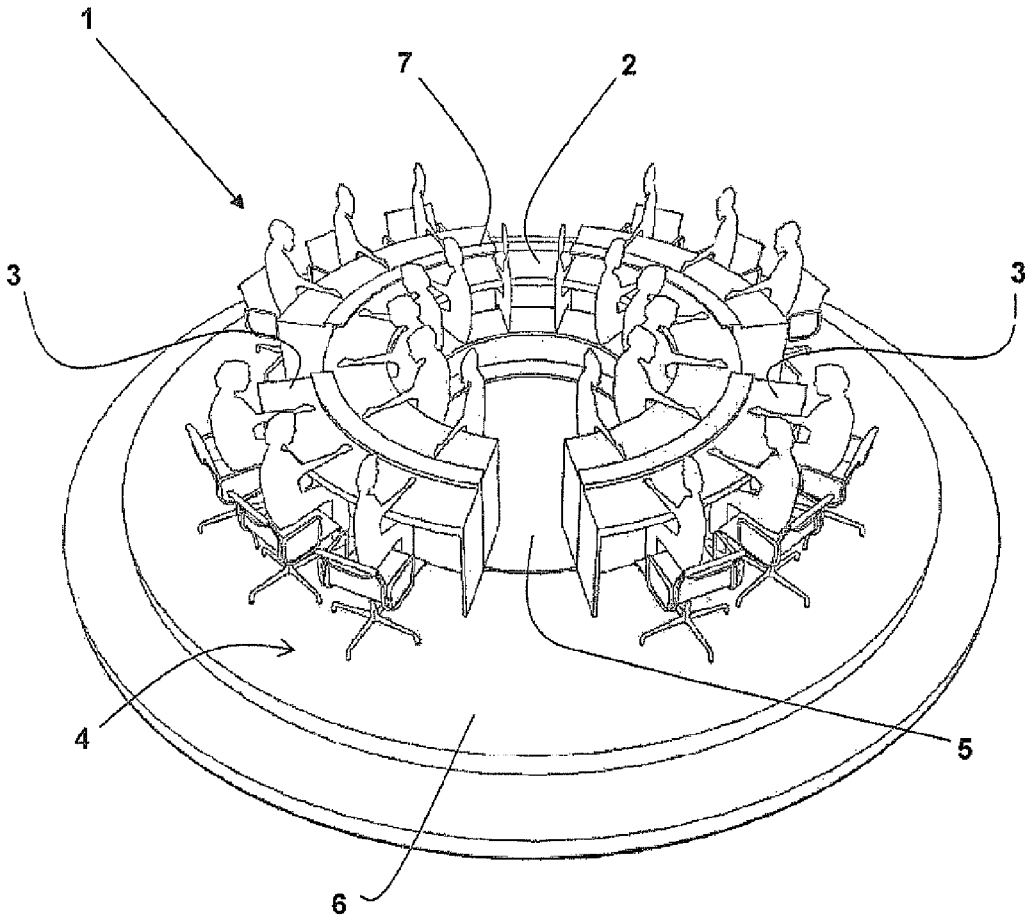
FIG. 1 shows a perspective view of a preferred embodiment of the table of the present invention.

One preferred embodiment of the table of the present invention is shown in the Figures. FIG. 1 shows a perspective view of the table 1 with twenty four people sat at it.

The people at the table are split in to two groups. The first group of people are seated at a first, inner table top 2, upon which are placed the place settings of twelve people. The second group of people are seated at a second, outer table top 3, upon which are placed the place settings of twelve more people.

The first and second table tops 2, 3 and the place settings accommodated thereon are arranged so that the people seated at the first table top 2 are face to face with the people seated at the second table top 3. In this way a person at the first table top is able to interact with the person sat directly across from them on the second table top.

By moving the first table top 2 relative to the second table top 3 it is possible to vary who the person at the first table top is faced with on the second table top, thus allowing that person to have conversations with many different people over the course of a social event or meeting.

Although the number and positioning of the place settings on the first and second table tops could simply be made by eye, it is envisaged that the table may preferably be provided with indexing means (not shown) to guide where the place settings should be located.

The indexing means also ensure that, in embodiments of the present invention which periodically move place settings, the place settings on the first table top always align with place settings on the second table top wherever possible. Although it is appreciated that this may not always be possible when the table has multiple exit/entry gaps (see below).

In the embodiment shown in FIG. 1 the first table top 2 is encircled by the second table top 3. For the benefit of both personal comfort and safety it is appreciated that the order that those people sat at the first, inner table top 2 are able to exit the inner region of the table that is defined by the inner table top without having to climb over or under the table.

In order to provide an exit, and indeed an entry point, for the inner region of the table defined by the first, inner table top 2 a gap is provided in the inner table top. The second outer table top 3 is also provided with gaps which, when aligned with the inner table gap, provide a point of both entry and exit for the inner region of the table.

In order to increase the opportunities for people to enter or exit the inner region of the table the second outer table top 3 of the preferred embodiment is provided with four gaps. It is appreciated that the total number of gaps provided in both the inner and outer table tops could be varied to suit a particular size of table (i.e. large tables have more gaps).

Figure 2:
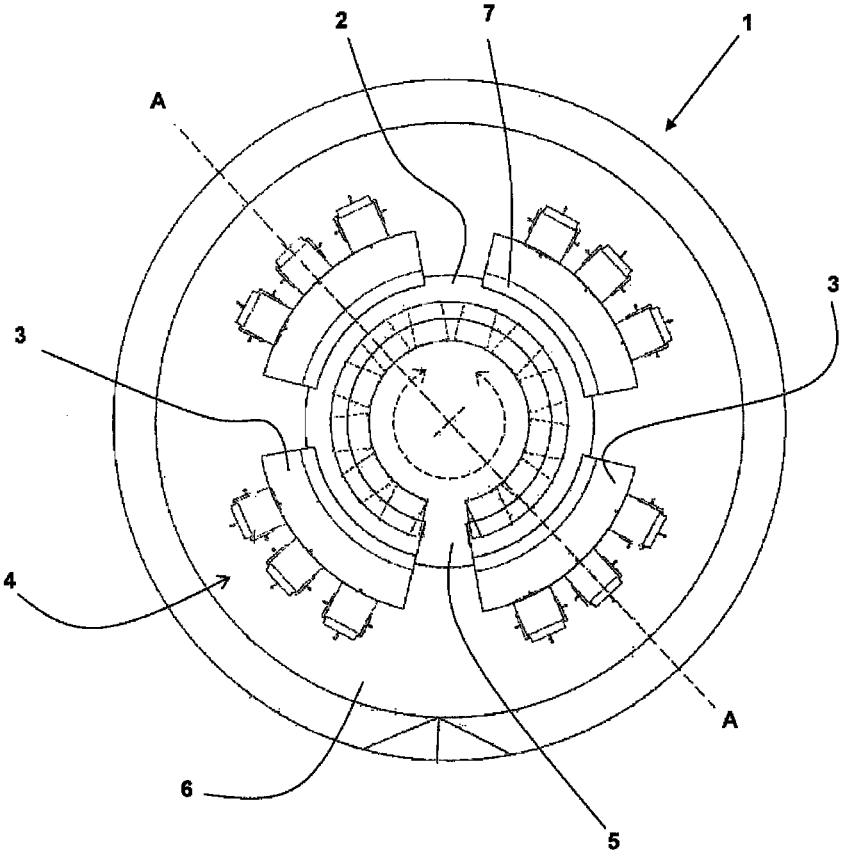
FIG. 2 shows a plan view of the preferred embodiment.
Figure 3:
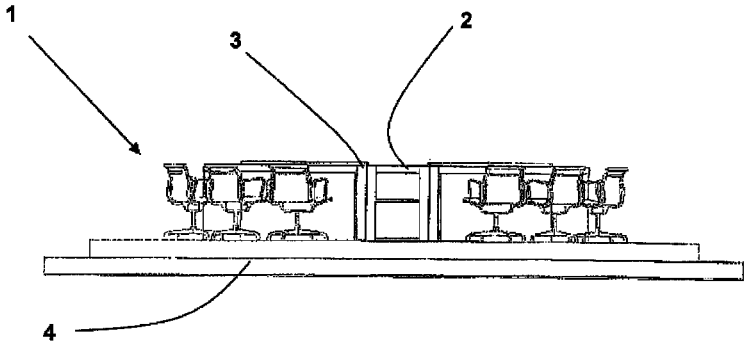
FIG. 3 shows a side view of the preferred embodiment.

It is appreciated having more than one gap in either the first or second table tops can result in the first or second table tops being separated into table top portions. This can be seen in FIG. 2 for the outer table top 3, which has four separate outer table top portions.

The first and second table tops 2, 3 of the table 1 are mounted on a base 4. The base 4 comprises a first supporting platform 5, upon which the first table top 2 and its associated seating 9 are located, and a second supporting platform 6, upon which the second table top 3 and its associated seating is located.

In order to accommodate the mechanisms 8 that facilitate the relative movement of the first and second table tops it is envisaged that table may be raised from the ground by the base 4. Preferably steps are provided on the base to enable guests to easily mount the base and take their seats.

Alternatively, in more permanent fittings of the table, it is envisaged that the base and the mechanisms that facilitate the relative movement of the first and second table tops could be received in a recess in the floor so that the supporting platforms 5 and 6 sit flush with the floor of a venue. In this way the table looks like a normal table.

Figure 4:
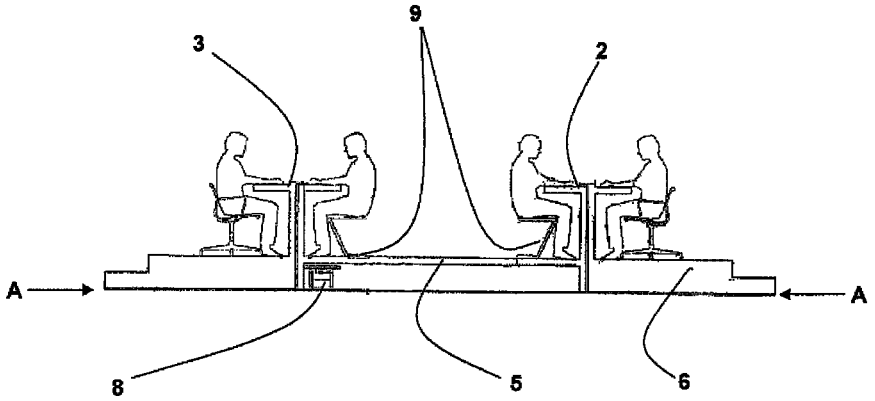
FIG. 4 shows a cross sectional view of the preferred embodiment shown in FIG. 2 through the line A-A.

The location of the mechanisms of the drive means 8 will be appreciated from FIG. 4. In the embodiment shown the relative movement of the first and second table tops is achieved by revolving the first supporting platform 5 within the second supporting platform 6, which is static.

However it is envisaged that the relative movement of the first and second table tops may also be achieved by revolving the second supporting platform 6 around the first supporting platform 5 which remains static. It is also considered possible that both the first and second table tops may be capable of revolving.

It will be appreciated that the construction of revolving support platform—which is shown as 5 in FIG. 4—must be stable, secure and appropriate to bear the weight of the first table top, the chairs and the people who will be seated at the place settings on the first table top.

For ease of assembly it is envisaged that that the table will be formed from prefabricated structural elements joined together at the usage site.

It will be appreciated that the revolving support platform 5 may be supported by a variety of means, although preferably the revolving support platform 5 will incorporate a series of support wheels spaced in a radial pattern. It is envisaged that the support wheels have tyres for quiet smooth operation.

Also it is envisaged that the rotary power to revolve the supporting platform 5 may be provided by a variety of sources (e.g. manual, pneumatic, electric, etc.). Preferably it is envisaged that the rotation is driven by an electric motor with a reduction gearbox coupled to a friction wheel. The friction wheel is then applied against a drive band on or around the supporting platform 5 to effect rotation in a smooth controlled manner.

In order for the first and second table tops 2, 3 to be free to move relative to one another there is a gap between them. For reasons of health and safety that gap is preferably covered by a lip or guard 7. The lip or guard 7, which may be mounted on or even part of either the first or second table top, is provided to prevent objects falling down the gap between the table tops. The lip/guard 7 also prevents fingers from being trapped.

It is envisaged that the relative movement of the table tops, which is achieved by the movement of the first (inner) table top in the described embodiment, may be gradual and constant or periodic and indexed.

It is envisaged that a speed of between 0.5 and 4 complete rotations per hour would be appropriate for the gradually moving arrangement.

Where the movement of the indexed place settings takes place periodically it is envisaged that the place settings might be moved by a set rotation (e.g. 90°) once every 30 minutes with the actual movement of the table tops being quicker.

For the sake of health and safety the table may be provided with alert means to indicate that a repositioning of the place settings is about to occur. In addition, the table may be provided with a safety shut off to prevent the repositioning of the place settings if, for example, someone is using the exit/entry gaps.

Although the above indicated speeds are considered preferable in general it is appreciated that the speed with which the place settings are realigned may be dictated by the type of occasion the table is being used for. To this end it is envisaged that the table is provided with control means to control both the speed of repositioning and also whether the repositioning is gradual or periodic.

The invention claimed is:

1. A table capable of accommodating place settings for a plurality of people, said table comprising:

a first table top, which accommodates place settings for one or more people, a second table top, which accommodates place settings for a plurality of people, and wherein the first table top place settings are alignable with the second table top place settings so that at least two people at the table are face to face; and characterized in that the first and second table tops are moveable relative to one another so that the alignment of the first table top place settings and the second table top place settings can be varied; wherein the first table top provides an inner edge of the table that defines an inner region within which people whose place setting is on the first table top can be situated, the second table top provides an outer edge of the table around which people whose place setting is on the second table top can be situated, wherein the first and second table top each have at least one gap therein which, when aligned, provide means of entry and egress from the inner region of the table.

2. The table of claim 1, wherein the table is generally circular in shape.

3. The table of claim 1, further comprising indexing means to facilitate the alignment of the place settings on the first table top with the place settings on the second table top.

4. The table of claim 1, further comprising a protective lip that extends over the area of the table where the first and second table top come in to close proximity.

5. The table of claim 1, further comprising a base with a first supporting platform for the first table top and a second supporting platform for the second table top; and wherein the movement of either the first platform, second platform or both platforms provide the relative movement of the first and second table tops.

6. The table of claim 5, where in the base is locatable within a floor so that the supporting platforms can lie flush with the floor.

7. The table of claim 5, wherein the base comprising drive means which control the movement of the first and second platforms.

8. The table of claim 5, wherein the first supporting platform has one or more seats secured to it.

9. A method of increasing the inter-personal communication opportunities of a plurality of people at a table, said method comprising:

a) providing a table according to claim 1;

b) positioning people at a plurality of places settings arranged on the first and second table tops;

c) moving the first and second table tops relative to one another over time so as to vary the alignment of the place settings on the first and second table tops thereby enabling different people to communicate with one another.

10. The method of claim 9, wherein the relative movement of the first and second table tops is continuous but at a nominal speed.

11. The method claim 9, wherein the relative movement of the first and second table tops occurs periodically at predetermined time intervals.

* * * * *